US005842394A

United States Patent [19]

Hwang

[11] Patent Number: 5,842,394

[45] Date of Patent: Dec. 1, 1998

[54] MULTIPLE BIT SCREWDRIVER

[76] Inventor: Shyan-Duu Hwang, 6F, No. 96, Liu-Kuei Rd., Ta-Li City, Taichung Hsien, Taiwan

[21] Appl. No.: 872,313

[22] Filed: Jun. 10, 1997

[51] Int. Cl.[6] ..... B25B 23/00

[52] U.S. Cl. ..... 81/439; 81/490

[58] Field of Search ..... 81/438, 439, 177.4, 81/177.5, 490, 125.1

[56] References Cited

U.S. PATENT DOCUMENTS

| | | | |
|---|---|---|---|
| 4,399,723 | 8/1983 | Marleau | 81/439 |
| 5,195,761 | 3/1993 | Eimer | 81/439 |
| 5,481,949 | 1/1996 | Yen | 81/438 |

FOREIGN PATENT DOCUMENTS

| | | | |
|---|---|---|---|
| 4127176-A1 | 2/1993 | Germany | 81/438 |

*Primary Examiner*—James G. Smith
*Assistant Examiner*—Benjamin M. Halpern
*Attorney, Agent, or Firm*—Rosenberg, Klein & Bilker

[57] ABSTRACT

A multiple bit screwdriver includes a tubular handle body with a first end portion, an opposite second end portion and an axial bore formed through the first and second end portions. A plurality of tool bits are inserted successively into the axial bore via the first end portion such that the tool bits are rotatable with the handle body, and are removable successively from the axial bore via the second end portion. Each of the tool bits has a bit portion and a connecting sleeve on one end of the bit portion. The connecting sleeve has an axial blind hole formed therein to permit extension of the bit portion of an adjacent tool bit therein. First and second spring units are respectively provided on the first and second end portions and extend radially inward into the axial bore. The first spring unit engages frictionally and resiliently the connecting sleeve of a first one of the tool bits that is located in the first end portion of the handle body so as to prevent the tool bits from falling out of the first end portion. The second spring unit engages frictionally and resiliently the connecting sleeve of a second one of the tool bits that has the bit portion thereof extending out of the second end portion. The second spring unit prevents the tool bits from falling out of the second end portion.

2 Claims, 6 Drawing Sheets

MULTIPLE BIT SCREWDRIVER

BACKGROUND OF THE INVENTION

1. Field of the Invention

The present invention relates to a multiple bit screwdriver, more particularly to a screwdriver which has multiple interchangeable tool bits received and retained removably in a handle body, which is relatively convenient to carry, and which can be operated in different manners to create different torsion forces to suit the requirement of a fastener to be driven.

2. Description of the Related Art

Since a variety of screwdriver bit types are required for different purposes, various modular screwdrivers have been suggested. An example of the conventional modular screwdriver generally includes a handle and tool bits with various head types. In use, a desired tool bit is selected and secured to one end of the handle, and the remaining tool bits are received in a casing. Carrying of the handle and the casing with multiple tool bits received therein for outdoor use in relatively inconvenient to the user. Moreover, the conventional modular screwdriver can only be operated in a single manner and is thus incapable of driving a fastener that requires increased torsion force.

SUMMARY OF THE INVENTION

The main object of the present invention is to provide a multiple bit screwdriver that can be used for driving fasteners with different head configurations and that can be used in different operating manners to generate different torsion forces to suit the requirement of the fastener to be driven, and that is relatively convenient to carry, especially during outdoor use.

Accordingly, the multiple bit screwdriver of the present invention includes a tubular handle body, a plurality of tool bits, and first and second spring units. The tubular handle body has a first end portion, an opposite second end portion and an axial bore formed through the first and second end portions. The tool bits are inserted successively into the axial bore via the first end portion of the handle body such that the tool bits are rotatable with the handle body, and such that the tool bits are removable successively from the axial bore via the second end portion of the handle body. Each of the tool bits has a bit portion and a connecting sleeve on one end of the bit portion. The connecting sleeve has an axial blind hole formed therein to permit extension of the bit portion of an adjacent one of the tool bits therein. The first spring unit is provided on the first end portion of the handle body, and extends radially inward into the axial bore to engage frictionally and resiliently the connecting sleeve of a first one of the tool bits that is located in the first end portion of the handle body so as to prevent the tool bits from falling out of the first end portion of the handle body. The second spring unit is provided on the second end portion of the handle body, and extends radially inward into the axial bore to engage frictionally and resiliently the connecting sleeve of a second one of the tool bits that has the bit portion thereof extending out of the second end portion of the handle body. The second spring unit prevents the tool bits from falling out of the second end portion of the handle body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
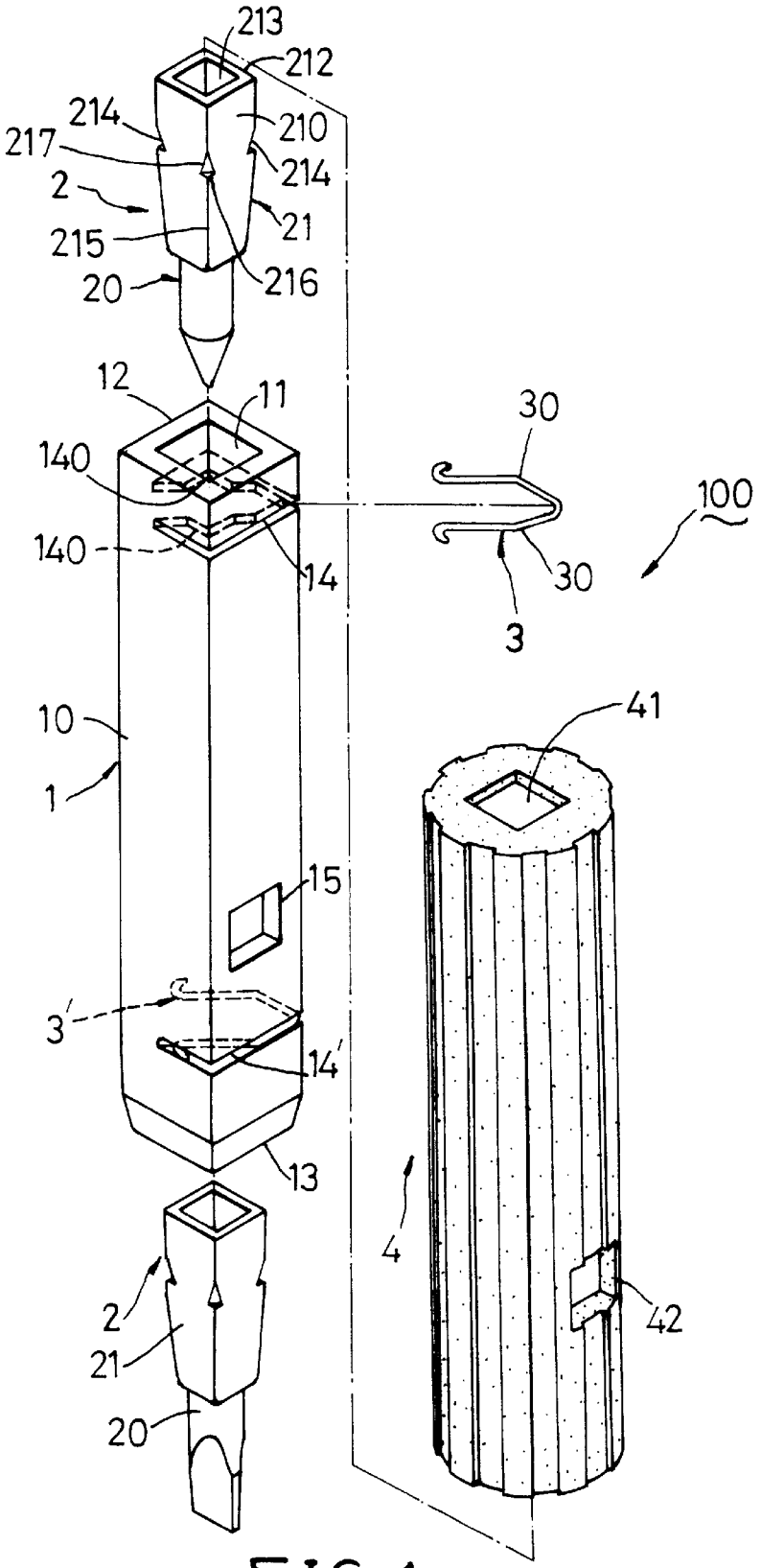
FIG. 1 is an exploded perspective view of a multiple bit screwdriver according to a first preferred embodiment of the present invention.

Referring to FIG. 1, the multiple bit screwdriver 100 according to the first preferred embodiment of the present invention is shown to include a tubular handle body 1, a plurality of tool bits 2, first and second spring units 3, 3', and a resilient sheath 4.

The tubular handle body 1 has a first end portion 12, an opposite second end portion 13 and a peripheral wall 10 which confines an axial bore 11 formed through the first and second end portions 12, 13. The axial bore 11 has a non-circular cross-section, such as a substantially rectangular cross-section in this embodiment, and has a uniform size throughout the handle body 1. The peripheral wall 10 is formed with a first radial slot 14 in the first end portion 12 and a second radial slot 14' in the second end portion 13. Each of the first and second slots 14, 14' has parts formed through the peripheral wall 10 at opposite corners 140 of the axial bore 11 for communication with the latter. The peripheral wall 10 is further formed with a substantially rectangular radial hole 15 having a size conforming with the cross-section of the axial bore 11.

The tool bits 2 are inserted successively into the axial bore 11 via the first end portion 12 of the handle body 1, and are removable successively from the axial bore 11 via the second end portion 13 of the handle body 1. Each of the tool bits 2 has a bit portion 20 and a connecting sleeve 21 on one end of the bit portion 20. The configurations of the bit portions 20 of the tool bits 2 differ one from another to suit the various head configurations of the fasteners to be driven. The connecting sleeve 21 of each of the tool bits 2 has a substantially rectangular cross-section conforming with that of the axial bore 11 of the handle body 1 so that the tool bits 2 are rotatable together with the handle body 1, and so that relative rotation among the tool bits 2 and the handle body 1 can be prevented. The connecting sleeve 21 of each of the tool bits 2 is formed with an axial blind hole 213 therein to permit extension of the bit portion 20 of an adjacent one of the tool bits 2 therein. The connecting sleeve 21 of each of the tool bits 2 further has four longitudinal edges 215, each of which is formed with an angled notch 214. Each of the angled notches 214 is defined by a horizontal lower wall 216 and an inclined upper wall 217. The notches 214 on the longitudinal edges 215 cooperatively form a retaining groove. The connecting sleeve 21 of each of the tool bits 2 has a section that is disposed between the notches 214 and the bit portion 20 and that tapers slightly toward the bit portion 20 to facilitate insertion thereof into the axial bore 11 via the first end portion 12 of the handle body 1.

Figure 2:
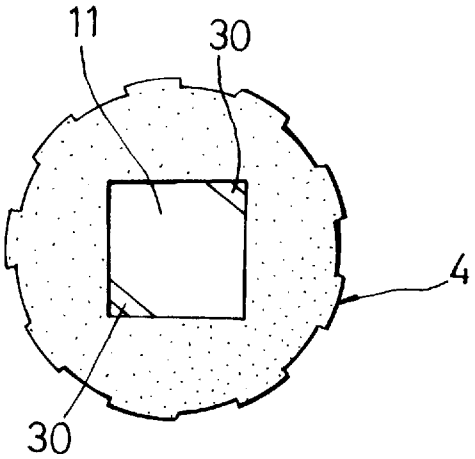
FIG. 2 is a top view of the first preferred embodiment in which tool bits are removed therefrom.

Referring to FIGS. 1 and 2, the first and second spring units 3, 3' are provided on the first and second end portions 12, 13, respectively. Each of the first and second spring units 3, 3' is formed as a generally V-shaped clip with two clamping portions 30. With the assistance of the resilient sheath 4 that is sleeved around the handle body 1, the clamping portions 30 of the first and second spring units 3, 3' are capable of extending radially inward through the first and second radial slots 14, 14', respectively, and into the axial bore 11 of the handle body 1. The clamping portions 30 of the first spring unit 3 extend into opposite two of the notches 214 of the connecting sleeve 21 of a first one of the tool bits 2 that is located in the first end portion 12 of the handle body 1 to engage frictionally and resiliently the same so as to prevent the tool bits 2 from falling out of the first end portion 12 of the handle body 1. The horizontal lower walls 216 of the notches 214 assist in preventing removal of the tool bits 2 via the first end portion 12 of the handle body 1. The clamping portions of the second spring unit 3' extend into and engage frictionally and resiliently opposite two of the notches 214 of the connecting sleeve 21 of a second one of the tool bits 2 that is located in the second end portion 13 of the handle body 1 and that has the bit portion 20 thereof extending out of the second end portion 13 of the handle body 1 for operation. The second spring unit 3' prevents the tool bits 2 from falling out of the second end portion 13 of the handle body 1.

The resilient sheath 4 is formed with an axial bore 41 with a rectangular cross-section that conforms with the shape of the handle body 1 so that the handle body 1 can be fittingly and resiliently sheathed by the resilient sheath 4. The resilient sheath 4 is further formed with a rectangular radial hole 42 registered with the radial hole 15 of the handle body 1.

Figure 3:
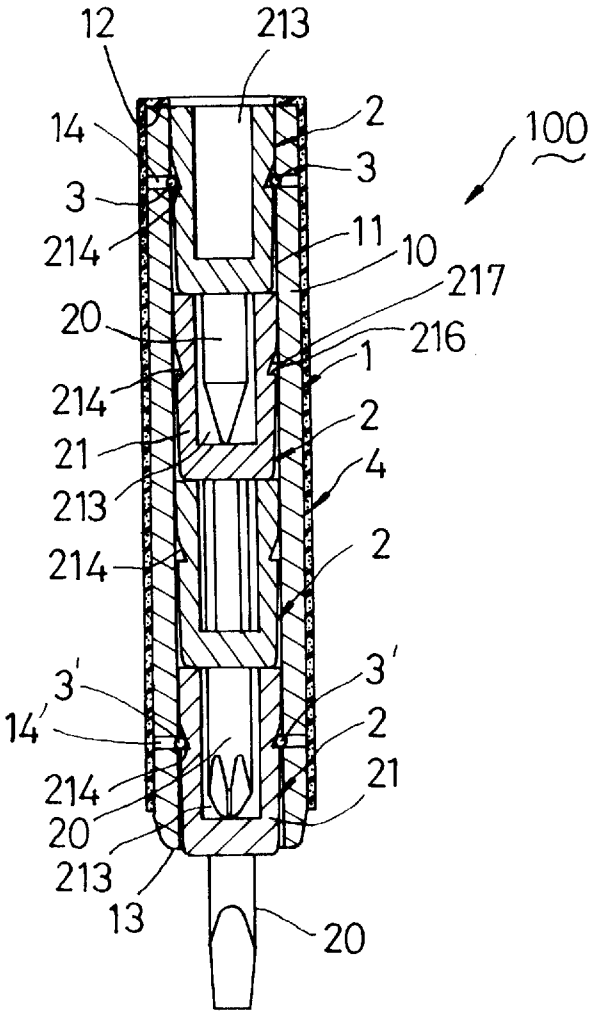
FIG. 3 is a sectional view of the first preferred embodiment.

Referring to FIGS. 2 and 3, the assembly of the screwdriver 100 is as follows. The first and second spring units 3, 3' are respectively received in the first and second slots 14, 14'. The resilient sheath 4 is then sleeved around the handle body 1 such that the radial hole 42 of the resilient sheath 4 is registered with the radial hole 15 of the handle body 1 and such that the clamping portions 30 of the first and second spring units 3, 3' extend radially inward into the axial bore 11 of the handle body 1, as shown in FIG. 2. One of the tool bits 2 is then inserted through the first end portion 12 with the bit portion 20 thereof oriented downwardly so that the notches 214 engage the first spring unit 3. Another one of the tool bits 2 is subsequently inserted into the first end portion 12 of the handle body 1, thereby pushing the previous one of the tool bits 2 downward for release from the first spring unit 3 so as to drop toward the second end portion 13. The inclined walls 216 on the notches 214 of said previous one of the tool bits 2 facilitate the release thereof from the first spring unit 3. The remaining ones of the tool bits 2 are then successively inserted into the axial bore 11 via the first end portion 12 of the handle body 1. In this embodiment, the handle body 1 is capable of receiving four tool bits 2 therein. When the uppermost one of the tool bits 2 has been inserted into the axial bore 11, and the notches 214 thereof engage the first spring unit 3, the lowest one of the tool bits 2 is forced downwardly so that the notches 214 thereof engage the second spring unit 3' and so that the bit portion 20 thereof extends out of the second end portion 13 of the handle body 1 for operation. The screwdriver 100 is now ready for use.

Figure 4:
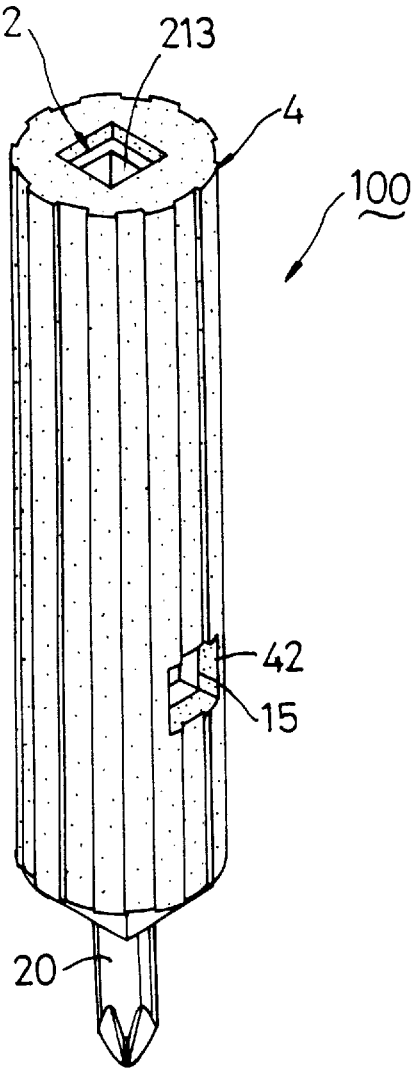
FIG. 4 is a perspective view of the first preferred embodiment to be used in a first operating manner.

Referring to FIG. 3, in use, the bit portion 20 of a desired tool bit 2, such as one with a flat bit portion, is allowed to extend out of the second end portion 13 of the handle body 1 for operation. When the tool bit 2 is subsequently changed, such as, into an adjacent one with a cross-shaped bit portion 20, as shown in FIG. 4, the tool bit 2 with the flat bit portion 20 is pulled downwardly so that the connecting sleeve 21 thereof is released from the second spring unit 3'. The tool bit 2 with the flat bit portion is then inserted once again into the axial bore 11 through the first end portion 12 so that the original uppermost tool bit 2 is forced downwardly for release from the first spring unit 3 and so that the tool bit 2 with the flat bit portion 20 engages the first spring unit 3. The tool bit 2 with the cross-shaped bit portion 20 is thus forced downwardly so that the connecting sleeve 21 thereof engages the second spring unit 3' and the bit portion 20 thereof extends out of the second end portion 13 for operation.

Figure 5:
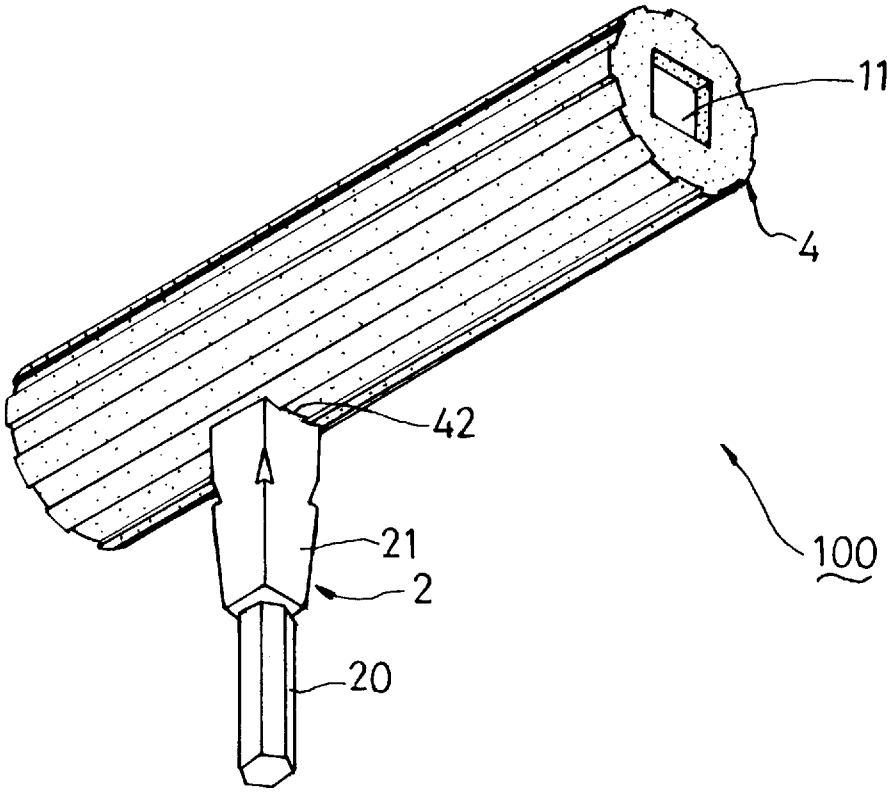
FIG. 5 is a perspective view of the first preferred embodiment to be used in a second operating manner.

When an increased torsion force is required for driving a screw, the screwdriver 100 of the present embodiment can be operated in a different manner as shown in FIG. 5. The connecting sleeve 21 of the desired tool bit 2 is inserted into the radial holes 42, 15 of the resilient sheath 4 and the handle body 1 to engage the same for operation.

Figure 6:
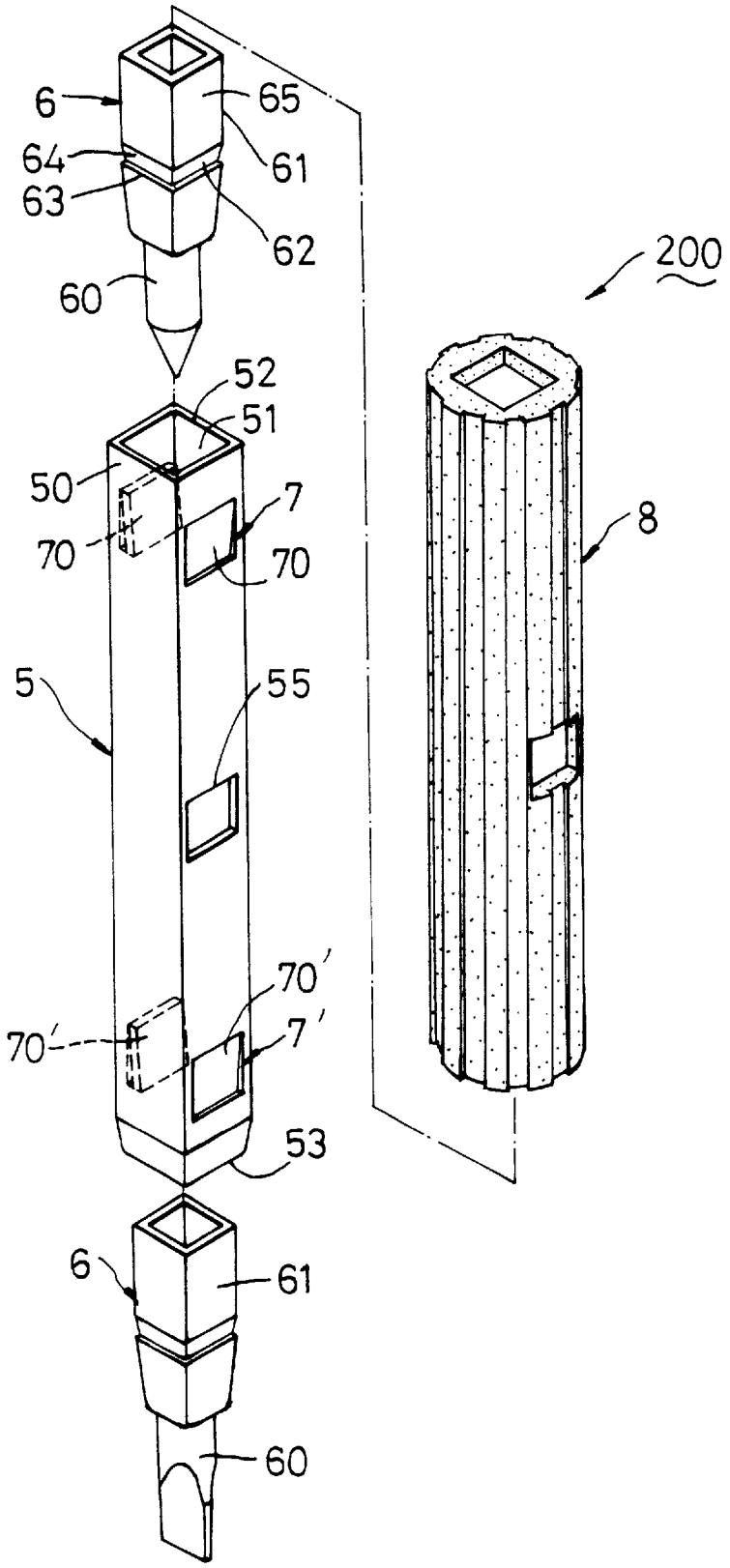
FIG. 6 is an exploded perspective view of a second preferred embodiment of the present invention.
Figure 7:
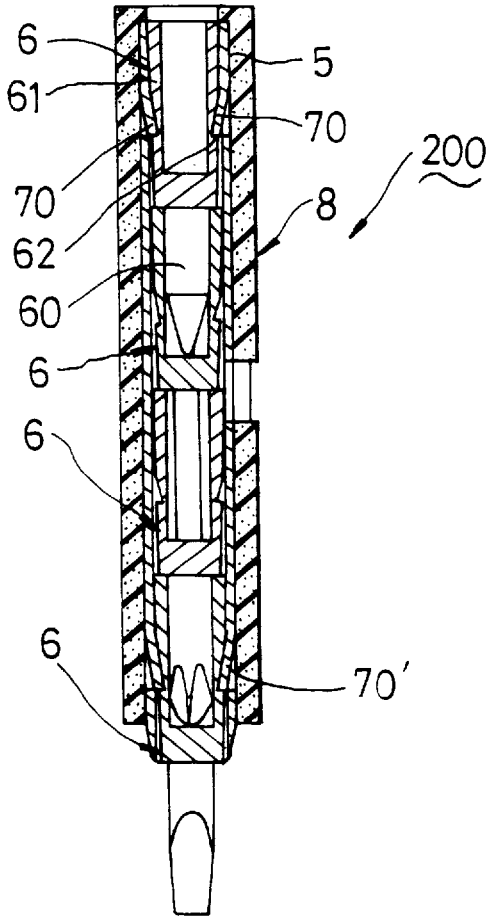
FIG. 7 is a sectional view of the second preferred embodiment.

Referring to FIGS. 6 and 7, a multiple bit screwdriver 200 according to the second preferred embodiment is shown to include a tubular handle body 5, a plurality of tool bits 6, first and second spring units 7, 7', and a resilient sheath 8.

The handle body 5, similar to that of the previous embodiment, has a first end portion 52, an opposite second end portion 53 and a peripheral wall 50 which confines an axial bore 51 formed through the first and second end portions 52, 53. The axial bore 51 also has a substantially rectangular cross-section and a uniform size throughout the handle body 5. The peripheral wall 50 has an opposite pair of first spring plates 70 and an opposite pair of second spring plates 70' which are formed integrally at the first and second end portions 52, 53, respectively, by punching. The first and second spring plates 70, 70' serve as the first and second spring units 7, 7', respectively, and extend radially inward into the axial bore 51. The peripheral wall 50 is further formed with a substantially rectangular radial hole 55 having a size conforming with that of the cross-section of the axial bore 51.

The tool bits 6, similar to those in the previous embodiment, are inserted successively into the axial bore 51 via the first end portion 52 of the handle body 5, and are removable successively from the axial bore 51 via the second end portion 53 of the handle body 5. The tool bits 6 have bit portions 60 with different configurations and connecting sleeves 61 with rectangular cross-sections. The connecting sleeve 61 of each of the tool bits 6 has four peripheral wall sections 65 and an angled peripheral retaining groove 62 which is formed around the wall sections 65 and which is defined by a horizontal lower wall 63 and an inclined upper wall 64. The first spring plates 70 are capable of extending into and engaging releasably the retaining groove 62 of the connecting sleeve 61 of a first one of the tool bits 6 that is located at the first end portion 52. The second spring plates 70' are capable of extending into and engaging releasably the retaining groove 62 of the connecting sleeve 61 of a second one of the tool bits 6 that is located at the second end portion 53 and that has the bit portion 60 thereof extending out of the second end portion 53.

The sheath 8 of this embodiment is similar to that of the previous embodiment.

Assembly and operation of the screwdriver 200 of this embodiment are similar to those of the previous embodiment and will not be detailed further.

If necessary, the handle body of the screwdriver can be made longer as desired for receiving a greater number of tool bits of different types therein.

Accordingly, the multiple bit screwdriver of the present invention has a plurality of tool bits received and retained removably in a handle body thereof and is thus relatively convenient to carry, especially during outdoor use, since an additional casing for receiving the tool bits is not necessary. Moreover, the screwdriver can be operated in two different manners to suit the torsion requirement of a fastener to be driven.

With this invention thus explained, it is apparent that numerous modifications and variations can be made without departing from the scope and spirit of this invention. It is therefore intended that this invention be limited only as indicated in the appended claims.

I claim:

1. A multiple bit screwdriver, comprising:

a tubular handle body which has a first end portion, an opposite second end portion and an axial bore formed through said first and second end portions;

a plurality of tool bits inserted successively into said axial bore via said first end portion of said handle body such that said tool bits are rotatable with said handle body and are removable successively from said axial bore via said second end portion of said handle body, each of said tool bits having a bit portion and a connecting sleeve on one end of said bit portion, said connecting sleeve having an axial blind hole formed therein to permit extension of said bit portion of an adjacent one of said tool bits therein;

a first spring unit provided on said first end portion of said handle body, said first spring unit extending radially inward into said axial bore to engage frictionally and resiliently said connecting sleeve of a first one of said tool bits that is located in said first end portion of said handle body so as to prevent said tool bits from falling out of said first end portion of said handle body; and a second spring unit provided on said second end portion of said handle body, said second spring unit extending radially inward into said axial bore to engage frictionally and resiliently said connecting sleeve of a second one of said tool bits that has said bit portion thereof extending out of said second end portion of said handle body, said second spring unit preventing said tool bits from falling out of said second end portion of said handle body, said connecting sleeve of each of said tool bits being formed with a peripheral retaining groove, said first and second spring units engaging releasably and respectively said retaining grooves of said first and second ones of said tool bits, said retaining groove being formed as an angled groove defined by a horizontal lower wall and an inclined upper wall, said horizontal lower wall preventing removal of said tool bits from said first end portion of said handle body, said inclined upper wall facilitating release of said tool bits from said spring units in a direction toward said second end portion of said handle body.

2. A multiple bit screwdriver, comprising:

a tubular handle body which has a first end portion, an opposite second end portion and an axial bore formed through said first and second end portions, said axial bore of said handle body having a non-circular substantially rectangular cross-section;

a plurality of tool bits inserted successively into said axial bore via said first end portion of said handle body such that said tool bits are rotatable with said handle body and are removable successively from said axial bore via said second end portion of said handle body, each of said tool bits having a bit portion and a connecting sleeve on one end of said bit portion, said connecting sleeve having an axial blind hole formed therein to permit extension of said bit portion of an adjacent one of said tool bits therein, said connecting sleeve of each of said tool bits having a non-circular substantially rectangular cross-section conforming with that of said axial bore of said handle body to prevent relative rotation among said handle body and said tool bits, said connecting sleeve of each of said tool bits having four longitudinal edges, each of which has a notch, said notches on said longitudinal edges cooperatively forming a retaining groove;

a first spring unit provided on said first end portion of said handle body, said first spring unit extending radially inward into said axial bore to engage frictionally and resiliently said connecting sleeve of a first one of said tool bits that is located in said first end portion of said handle body so as to prevent said tool bits from falling out of said first end portion of said handle body; and a second spring unit provided on said second end portion of said handle body, said second spring unit extending radially inward into said axial bore to enrage frictionally and resiliently said connecting sleeve of a second one of said tool bits that has said bit portion thereof extending out of said second end portion of said handle body, said second spring unit preventing said tool bits from falling out of said second end portion of said handle body, each of said notches being formed as an angled notch and is defined by a horizontal lower wall and an inclined upper wall, said horizontal lower wall preventing removal of said tool bits from said first end portion of said handle body, said inclined upper wall facilitating release of said tool bits from said spring units in a direction toward said second end portion of said handle body.

* * * * *